US006722243B2

(12) United States Patent
Adami

(10) Patent No.: US 6,722,243 B2
(45) Date of Patent: Apr. 20, 2004

(54) APPARATUS FOR THE TRANSVERSE CUTTING OF WEBLIKE MATERIAL

(75) Inventor: Mauro Adami, Lucca (IT)

(73) Assignee: Fosber S.p.A., Lucca (IT)

( * ) Notice: Subject to any disclaimer, the term of this patent is extended or adjusted under 35 U.S.C. 154(b) by 0 days.

(21) Appl. No.: 10/300,712

(22) Filed: Nov. 20, 2002

(65) Prior Publication Data

US 2003/0084768 A1 May 8, 2003

Related U.S. Application Data

(63) Continuation of application No. 09/433,320, filed on Nov. 3, 1999, now Pat. No. 6,553,883.

(30) Foreign Application Priority Data

Feb. 25, 1999 (EP) ..... 99830098

(51) Int. Cl.[7] ..... B31B 1/16; B26D 1/62; B26D 3/10; B26D 5/12

(52) U.S. Cl. ..... 83/508.1; 83/305; 83/341; 83/555; 83/595; 83/678; 83/911; 493/22

(58) Field of Search ..... 493/365, 22, 60, 493/96; 83/911, 595, 596, 332, 341, 508.1, 649, 304, 305, 678, 555, 669, 670

(56) References Cited

U.S. PATENT DOCUMENTS

| | | | |
|---|---|---|---|
| 700,807 | A | 5/1902 | Palmer et al. |
| 1,625,862 | A | 4/1927 | Martin |
| 1,659,069 | A | 2/1928 | Aldrich et al. |
| 1,746,048 | A | 2/1930 | Novick |
| 1,797,448 | A | 3/1931 | Sheldon |
| 1,849,501 | A | 3/1932 | Macfarren et al. |
| 1,965,523 | A | 7/1934 | Macfarren |
| 2,274,452 | A | 2/1942 | Macfarren |
| 2,696,150 | A | 12/1954 | Temperley |
| 2,768,690 | A | 10/1956 | Roberts et al. |
| 2,784,784 | A | 3/1957 | Haumann |
| 2,823,748 | A | 2/1958 | Petereit |
| 2,870,840 | A | 1/1959 | Kwitek |
| 2,986,329 | A | 5/1961 | Tailleur |
| 3,410,183 | A | 11/1968 | Sarka |
| 4,007,652 | A | 2/1977 | Shinomiya et al. |
| 4,159,661 | A | 7/1979 | Russell et al. |
| 4,276,797 | A | 7/1981 | Baumann et al. |
| 4,432,746 | A | 2/1984 | DeHaan |
| 4,695,005 | A | 9/1987 | Gietman, Jr. |
| 4,846,035 | A | 7/1989 | Granger |
| 4,943,341 | A | 7/1990 | Mattei |
| 4,983,155 | A | 1/1991 | Stobb |
| 5,098,366 | A | 3/1992 | Gressman |
| 5,152,205 | A | 10/1992 | Yoshida et al. |
| 5,297,461 | A | 3/1994 | Hirakawa et al. |
| 5,351,589 | A | 10/1994 | Creaden |
| 5,427,005 | A | 6/1995 | Breton |
| 5,464,166 | A | 11/1995 | Kirkpatrick, III et al. |
| 5,540,128 | A | 7/1996 | Creaden |
| 5,937,719 | A | 8/1999 | Davis et al. |
| 5,979,278 | A | 11/1999 | Warthen et al. |
| 6,026,727 | A | 2/2000 | Meeks |
| 6,165,117 | A | 12/2000 | Adami |

FOREIGN PATENT DOCUMENTS

| | | |
|---|---|---|
| BE | 568760 | 11/1960 |
| DE | 919 083 | 10/1954 |
| DE | 1 611 769 | 1/1971 |
| DE | 26 56 242 B1 | 5/1978 |
| EP | 0 559 077 A1 | 9/1993 |
| EP | 0 607 084 A1 | 7/1994 |
| EP | 0 737 553 B1 | 10/1996 |
| EP | 0 836 938 A2 | 4/1998 |
| EP | 0 894 586 A2 | 2/1999 |
| WO | 93/19904 | 10/1993 |

*Primary Examiner*—Charles Goodman
(74) *Attorney, Agent, or Firm*—Michael Best & Friedrich LLP

(57) ABSTRACT

A rotating cutting cylinder and an opposing member, wherein the cutting cylinder is fitted with a plurality of blade segments distributed along the length of the cutting cylinder and connected to one or more actuators for producing a movement of selective extension and retraction of said blade segments with respect to said cutting cylinder.

45 Claims, 5 Drawing Sheets

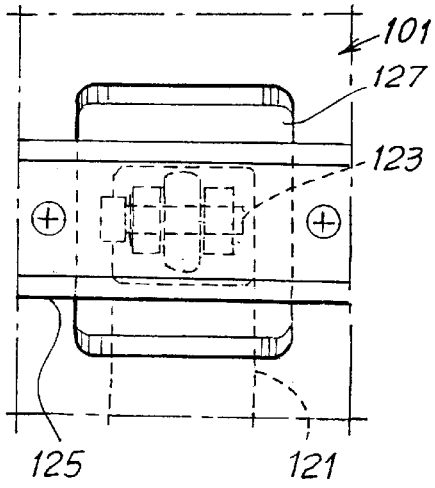
Fig. 5A
Fig. 6
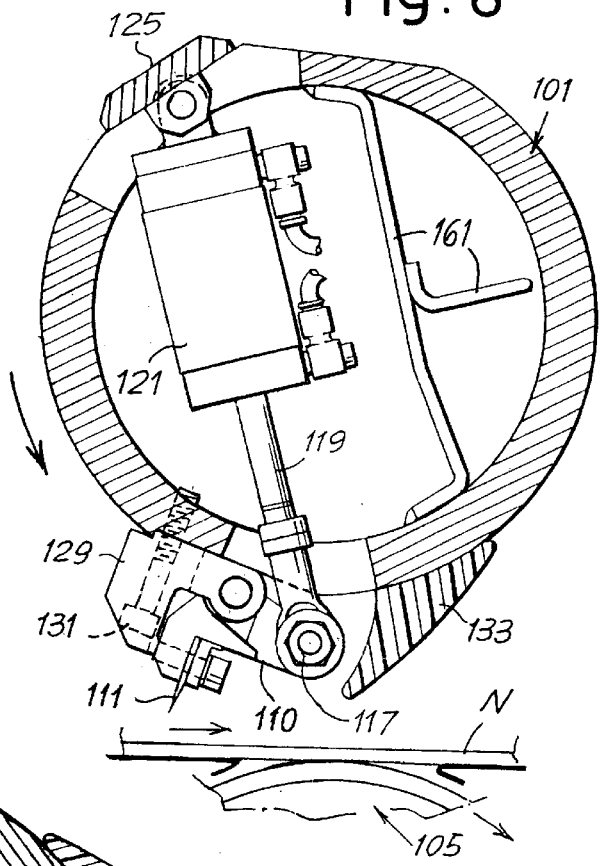
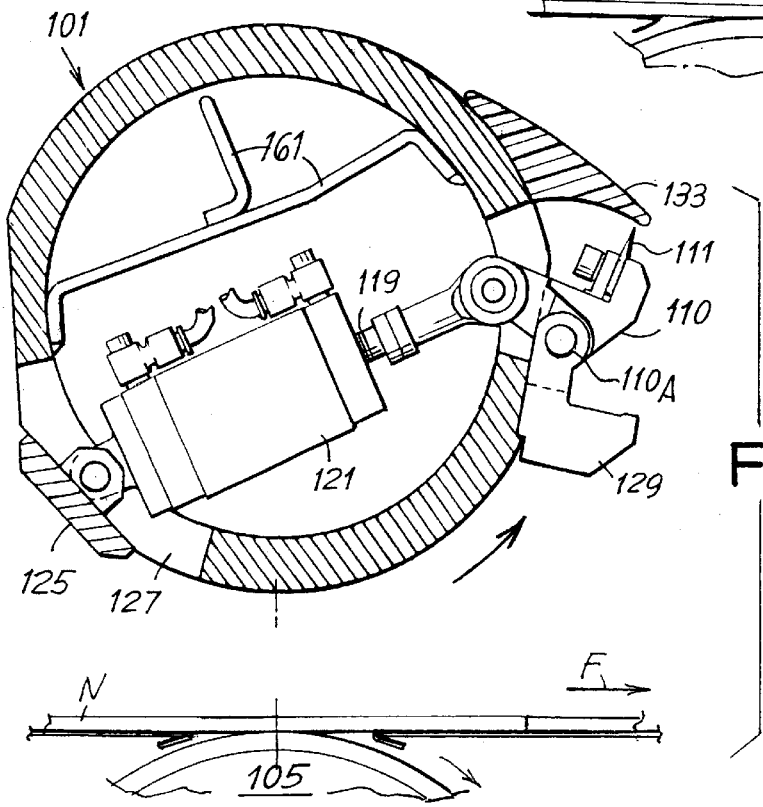
Fig. 7

APPARATUS FOR THE TRANSVERSE CUTTING OF WEBLIKE MATERIAL

RELATED APPLICATIONS

This application is a continuation of and claims priority to co-pending U.S. patent application Ser. No. 09/433,320, filed Nov. 3, 1999.

FIELD OF THE INVENTION

The present invention relates to an apparatus for producing discontinuous cuts in a weblike material fed continuously through said apparatus. The invention also relates to a method for making discontinuous transverse cuts in a continuously fed weblike material through said apparatus.

More particularly, but not exclusively, the present invention relates to a cutting device for cutting transversely at selectable points or portions a web of board fed to a slitter/scorer for the manufacture of slit and scored sheets of board.

BACKGROUND OF THE INVENTION

In many industries there is a need to cut a weblike material, e.g., a web of board, paper, fabric, plastic or other—fed continuously along a longitudinal path of forward travel—in predetermined and selectable portions or points along the width of the weblike material—often without interrupting the material, i.e., without generating two completely separate pieces of material.

This requirement occurs particularly in the industry of the manufacture of slit and scored sheets of corrugated board for the manufacture of boxes. In installations for slitting and scoring corrugated board webs for the manufacture of sheets from which boxes or the like will be made up, a web of corrugated board is fed continuously to a slitter/scorer, where the web is slit and scored longitudinally in predetermined positions and the slit and scored web is fed to a transverse cutting system to produce the individual sheets. Transverse cutting is performed in some cases by two (or more) cutters arranged at different heights or levels, in which case it is necessary to divide the path of the board web downstream of the slitter/scorer so that separate portions of board are fed to the separate levels at which the cutters are located. The longitudinal slitting of the board is performed by the blades of the slitter/scorer.

When one job is terminated and the next job is to begin, the position of the longitudinal slitting and scoring lines produced on the board is altered so that the transverse dimensions of the pieces of board fed to the different heights or levels at which the transverse cutters are situated change. Where the job changeover occurs, a transverse cut must be made in order to connect up the two longitudinal slits of the new job and the old job, ensure that the board does not tear at this point, and achieve uniformity in the tensile force applied to the weblike material.

The position in which the transverse cut line is effected is variable. Moreover, the transverse cut line must be short enough not to interrupt the strips of boards in the transverse direction as these would otherwise suffer skidding and loss of alignment during their conveyance.

A variety of different systems have been investigated in order to solve these problems either wholly or partly. For example, U.S. Pat. No. 5,297,461 discloses a transverse cutting apparatus in which a cutting cylinder comprising a continuous blade extending all the way along the length of the cylinder acts in combination with an opposing cylinder carrying opposing pads whose angular positions around the opposing cylinder can be selected by an angular movement about the axis of the opposing cylinder. By this means one or more of the opposing pads can be brought selectively into position such as to act in combination with the cutting blade. At the points at which the pads act in combination with the cutting blade the board is cut, whereas at points at which there is no pad underneath the cutting blade the board is not cut.

U.S. Pat. No. 5,152,205 discloses a system similar to the previous system in which the blade mounted on the system, cutting cylinder acts in combination with a series of lower pads that can be selectively raised or lowered in defined locations of the width of the board where the cut lines are produced.

The resulting cut is not accurate and there is a risk that the board may also be cut in locations where the cutting blade does not act in combination with an opposing lower pad. Furthermore, with these systems there is no way to select the locations to be cut with sufficient accuracy, nor to prevent transverse interruption of the strips of board.

European patent application No. 98 830 449.9 (publication No. EP-A-O 894583) and the corresponding U.S. application Ser. No. 09/124,017 by the same applicant, disclose an improved system in which a blade mounted on a rotating cutting cylinder acts in combination with a backing consisting of a pad mounted on an opposing cylinder. The pad can be moved longitudinally and angularly with respect to the axis of the opposing cylinder and also is so shaped that it is possible to produce, in combination with the blade, cut lines of the desired length and position. In addition, in this system the cutting tools of the slitter/scorer can be operated independently of each other. In this way it is possible to interrupt all the longitudinal slit lines of the old job and new job with the exception of the two central lines which in both jobs divide the board into the two portions which must be directed to the two levels where the cutters are located. As a result a job changeover region is generated containing only the two central slit lines which are joined by a cut approximately at right angles to the direction of forward travel of the board. This ensures the continuity of all the strips into which the board is divided.

U.S. Pat. No. 4,007,652 discloses a system in which the two intermediate longitudinal slit lines that divide the board into the two portions fed to the two separate levels where the transverse cutters are located are joined together by an inclined cut produced by a water nozzle traversing at right angles to the feed direction of the weblike material. The same solution is disclosed in EP-A-O 607 084. The use of a water nozzle for the inclined transverse cut has some advantages, including that of avoiding the complete transverse cut through one or more of the strips into which the board web is divided. This apparatus, however, has the disadvantage of high cost and requires a high level of attendance during operation because of the criticality of the water cutting system.

EP-A-0 737 553 discloses a system in which water nozzles are used to cut the lateral trimmings, the purpose being to obtain a continuous trimming along both sides of the board.

SUMMARY OF THE INVENTION

The present invention includes a rotating cutting cylinder and an opposing member, wherein the cutting cylinder is fitted with a plurality of blade segments distributed along the length of the cutting cylinder and connected to one or more actuators for producing a movement of selective extension and retraction of said blade segments with respect to said cutting cylinder.

Depending on the positions of the central slit lines to be joined by the transverse cut, the actuators extend one or more blade segments in the desired position to effect the selective localized cut through the weblike material. The cut may preferably be at right angles to the direction in which the weblike material is fed, or slightly inclined, e.g., as a consequence of a slightly helical arrangement of the blade segments on the cutting cylinder. However, cuts inclined relative to the feed direction are not ruled out.

In the following description and in the appended claims, reference will frequently be made to a pair of central lines that are joined by the transverse cut produced by the blade segments mounted on the cutting cylinder. It should however be noted that the term "central" is to be understood here as meaning exclusively a position which divides the weblike material into longitudinal pieces intended to be fed to transverse cutters located at different levels. In light of this, the so-called central lines may be in any intermediate position relative to the widths of the weblike material, and may for example be much closer to one longitudinal edge than to the other. Also it should be realized that, although the remainder of the text will refer primarily to a system in which the weblike material is divided into longitudinal strips which are then fed onto two separate levels, the inventive concept is not limited to this embodiment. On the contrary, the same concept can be extended to the scenario in which the weblike material is divided into a plurality of strips or groups of strips which are then sent to a corresponding plurality of different levels for the transverse cut. In this case the transverse cut joining together the longitudinal so-called central slit lines will be repeated on each pair of longitudinal slit lines corresponding to the portion containing the division between adjacent pieces of weblike material directed to different levels. Indeed, the cutting apparatus according to the invention presents almost no limits in terms of the number, length and position of the transverse cut lines.

In practice, it is advantageous to have one actuator for each blade segment, or for a limited number of contiguous blade segments. The actuators can be housed in an axial cavity inside the cutting cylinder. They may comprise one piston/cylinder actuator (generally of pneumatic type) for each blade segment. The possibility of also using hydraulic type piston/cylinder actuators is not ruled out, although this adds complications from the engineering point of view. Alternatively, mechanical, electromechanical, electromagnetic or other types of actuators can be used.

For example, each blade segment may be controlled in its movements of extension and retraction by an electromagnet with a mechanical return member. Alternatively, electric motors may be used with suitable mechanical drives, e.g., gears. A mechanical actuating apparatus may use a mechanism employing a cam or eccentric and a tappet or rocker arm, with a double-acting cam or eccentric, with a grooved cam profile or with elastic return members.

If a piston/cylinder actuator is used, this may act directly on a pivoting member carrying the blade segment, as in the example which will be described below, but the possibility of also using more complex arrangements in which the piston/cylinder actuator or equivalent means acts on the component carrying the blade either directly, or via a series of levers and drives, is not ruled out.

The piston/cylinder actuators, the electric motors and other equivalent actuators usable in the present application include both linear and rotary actuators.

Preferably, for reasons both of cost and of reliability, simplicity and bulk, linear pneumatic piston/cylinder actuators are currently preferred.

The cutting cylinder may be provided with a continuous rotational motion and may be activated only at the moment when the job changeover is required, by the actuation of the blade segment extender actuators. However, this is not as a rule required and the cutting cylinder may remain stationary throughout the processing of a job, being rotated (preferably for one revolution only) at the conclusion of the processing of one job and at the start of the next process.

The cutting apparatus may be placed upstream or downstream of the system that slits the board longitudinally, as the transverse cut can also be produced by the blade segments in a weblike material not yet divided into longitudinal strips. By positioning the cutting apparatus upstream of the system that slits the board longitudinally, i.e., in practice upstream of the slitting and scoring stations, it is possible to use the same cutting apparatus as an auxiliary cutter in order to introduce, when required, a complete transverse cut across the weblike material. This necessity may occur, for example, where the weblike material coming from the upstream manufacturing machine (i.e., for example from the corrugator) vanes in width. If this happens, where the change of width of the weblike material occurs, a complete transverse cut must be made and the lateral trimmings be reintroduced into the suction mouths. In conventional installations this complete transverse cut is performed by an additional machine provided expressly for this purpose and situated upstream of the slitter/scorer. With the cutting apparatus according to the invention it is possible to make both the complete transverse cut, and the partial transverse cut that joins the central longitudinal cut lines, with the same apparatus. For this purpose all that is required is an appropriate control of the blade segments which, in the first scenario, will all be extended from the cutting cylinder.

The complete transverse cut may also be required, for example, in order to discard a piece of weblike material. In this case the cutting apparatus can perform this function even if positioned downstream of the slitter/scorer unit.

The possibility is not ruled out that the cutting apparatus may be placed in other intermediate positions, such as between a longitudinal slitting station and a succeeding longitudinal scoring station, or between a scoring station and a slitting station arranged downstream of the scoring station. Generally speaking, although the arrangement in which the cutting apparatus is upstream of the slitter/scorer is preferable for the above mentioned reasons, it can be in any intermediate position between the feed point of the weblike material from the upstream manufacturing station (or from a supply roll) and the point at which the longitudinally slit weblike material is divided onto a plurality of levels.

The opposing member may take the form of a fixed pad, or of a continuous belt traveling over a supporting system in the same direction as the direction of forward travel of the weblike material, so that it supports the weblike material as it advances during the cut. Preferably, however, the opposing member is a rotating cylinder suitably covered with a soft material so as not to damage the blade while it is cutting. Nonetheless, the use of a revolving opposing blade as the opposing member, as in other shear cutting systems, is not ruled out.

To obtain an accurate and easily controllable movement, in an especially advantageous embodiment each blade segment is supported by a pivoting part hinged about a hinge axis, the extension and retraction of said blade segments being produced by a pivoting movement of said pivoting part about said hinge axis. The hinge axis may be parallel or approximately parallel to the axis of the cutting cylinder. In reality, it being advantageous (for reasons explained later) that the blade segments be arranged in a helical manner, the hinge axes of the corresponding supporting pivoting parts will be inclined, if only slightly, relative to the axis of the cutting cylinder.

In an especially advantageous embodiment, the hinge axis is external to the cutting cylinder. However, an arrangement in which the hinge axes of the blade segments are internal to the cutting cylinder is not ruled out.

In order to reduce the stresses on the controlling actuators of the individual blade segments and ensure that they do not retreat during cutting, it may advantageously be arranged that a stop is connected to each pivoting part to absorb at least some of the stresses exerted on the corresponding blade segment during the cutting. In practice it is also useful for each blade segment to be situated, when in its extended position, between the hinge axis of its pivoting part and the corresponding stop.

The apparatus according to the invention can be used to carry out a method for producing discontinuous transverse cuts in a weblike material fed continuously along a longitudinal feed path, comprising the following stages:

arranging a rotating cutting cylinder on a first side of said longitudinal path;

arranging an opposing member on a second side of said path;

selecting at least one portion of said weblike material along its width; and cutting said weblike material along said at least one selected portion without interrupting the weblike material;

characterized in that a plurality of selectively extendable and retractable blade segments are arranged on the cutting cylinder; and one or more of said blade segments is/are selectively extended toward said at least one selected portion in order to cut said weblike material transversely in the selected portion.

Other independent advantageous features and embodiments of the invention are indicated in the accompanying claims.

BRIEF DESCRIPTION OF THE DRAWINGS

A clearer understanding of the invention will be obtained from the description and the attached drawing, the latter showing a practical, non-restrictive example of an embodiment of the invention. In the drawing:

FIG. 5A shows a partial view marked VA—VA in FIG. 5; and

FIGS. 6 and 7 show the same section as FIG. 5 with the blade segment in the extended position and retracted position, respectively.

DETAILED DESCRIPTION

Figure 1:
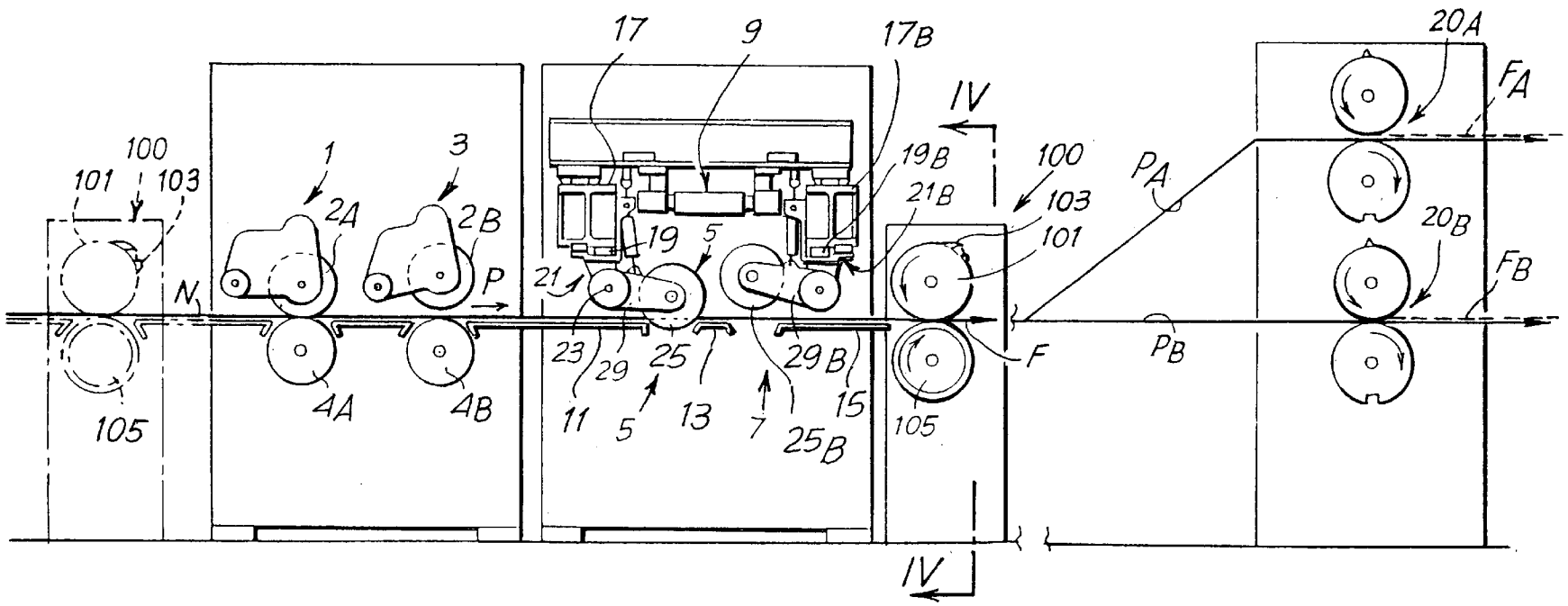
FIG. 1 is a schematic of an installation comprising a slitter/scorer, a cutting apparatus according a to the invention and an assembly of two transverse cutters arranged on two levels.

FIG. 1 shows in a general way the structure of a machine for slitting and scoring a weblike material N arriving, for example, from a corrugated board manufacturing line. The machine comprises a first scoring station 1, a second scoring station 3, a first slitting station 5 and a second slitting station 7. The four stations (forming the so-called slitter/scorer) can be arranged in various ways and in the example illustrated the two scoring stations are upstream of the slitting stations, but this is not obligatory. Arrangements in which the scoring and slitting stations are positioned alternately, or in which the slitting stations are upstream of the scoring stations, are also possible.

The invention will be described below with reference to a complex machine which is also fitted with scoring tools, but it will be understood that the invention can also be applied to other machines, for instance machines without scoring tools. Moreover, the configuration of the slitting and scoring stations is not obligatory, and the cutting apparatus according to the invention can be combined with any type of slitter/scorer capable of producing a weblike material slit longitudinally into pieces that are then sent to two or more levels for the subsequent transverse cut.

In the layout shown in FIG. 1, the scoring tools of station 1, marked 2A, 4A, are working, while those of station 3, marked 2B, 4B, are disengaged from the weblike material N and may be positioned by a special positioning robot (not shown). The slitting tools 25B of station 7 are not working and may be positioned by the positioning robot which has the general label 9, while the tools 25 of station 5 are working.

The two slitting stations 5 and 7 are more or less symmetrical and their component parts are therefore substantially the same.

The letter P indicates the longitudinal path of the weblike material N which travels through the slitting stations 5, 7 on sliding surfaces 11, 13, 15.

Slitting station 5 comprises, in the non-restrictive embodiment shown by way of example, a cross member 17 on the underside of which is a track 19 running transversely to the direction F of forward travel of the weblike material. A plurality of slitting units 21, one of which is visible in longitudinal section on a vertical plane in FIG. 1, run along the track 19.

The various slitting units 21 are mounted on a drive shaft 23 which provides the motion to the various slitting tools 25 of the slitting units 21. Each slitting tool 25 is keyed to a mandrel supported at the end of an arm 29 which pivots about the axis of the drive shaft 23. The tool rotates counter-clockwise, in the example, and has a peripheral speed of typically 3–4 times the speed of forward travel of the weblike material N. The speed of rotation of the slitting tools 25 can also be significantly different from that indicated above and be equal to or only slightly greater than the speed of forward travel of the weblike material. This happens, when, for example, the slitting tools each consist of a pair of diskoidal blades acting in combination with a shearing or scissors action.

Slitting station 7 is arranged symmetrically to station 5 and identical numbers followed by the letter B indicate identical or corresponding parts.

In a manner known per se (e.g., from one of the publications cited in the introductory part), the slitting and scoring tools of stations 1, 3, 5, 7 produce parallel slit and score lines on the weblike material N in a particular distribution across the transverse direction of the weblike material. One of the slit lines produced by one of the tools 25 divides the weblike material N into two portions that are directed along two paths PA and PB, on which there are respective transverse cutters 20A, 20B situated at two different levels, to cut the longitudinal strips into sheets FA and FB, as sketched downstream of the cutters 20A, 20B.

Figure 2:
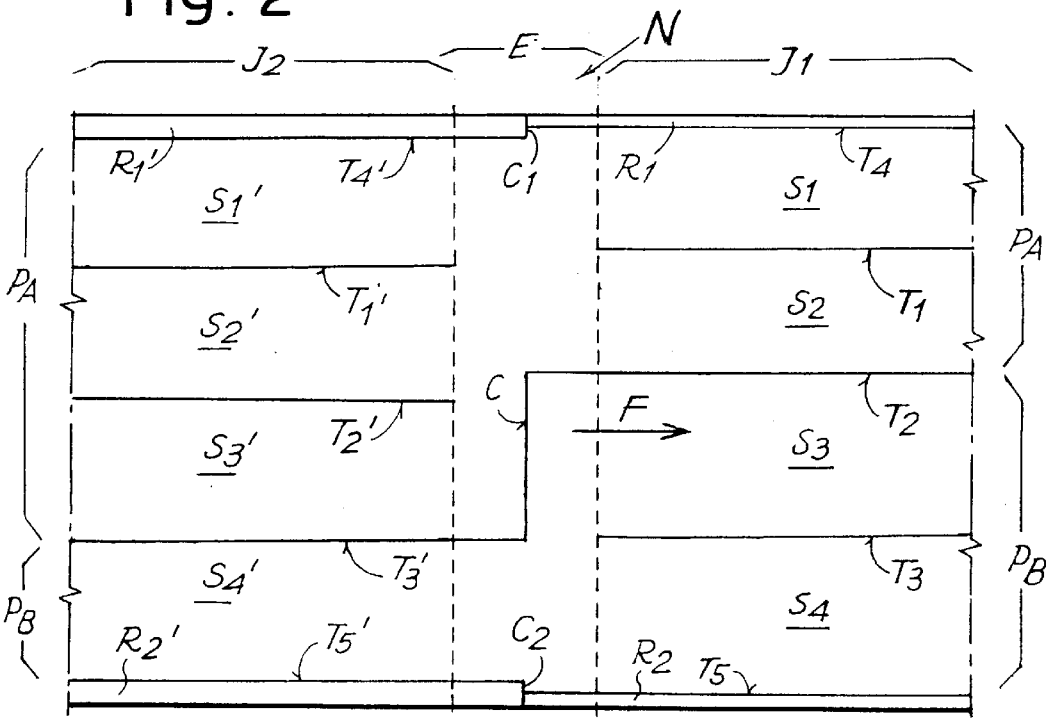
FIG. 2 shows the region of a job changeover on the weblike material in a first embodiment of the invention.

When the processing of one job has been completed, the working slitting tools 25 and scoring tools 2A, 4A are raised and disengaged from the weblike material, while slitting tools 25B and scoring tools 2B, 4B begin to work. They have first been placed in positions normally different from those of the tools that were working before, and corresponding to the specifications of the new job. The region of the job changeover looks as shown in FIG. 2, where the score lines have been omitted to simplify the drawing. J1 indicates the end of the old job and J2 the start of the new job. The letter E denotes the region of the job changeover. In the old job the weblike material was divided into four strips S1, S2, S3, S4 by three slit lines T1, T2, T3. Two lateral trimmings R1, R2 were produced by two additional slit lines T4 and T5. Strips S1 and S2 were directed along path PA, while strips S3, S4 were directed along path PB. Slit line T2 therefore constitutes the central line that divides the strips directed to the two levels. As mentioned earlier, the term "central" is not intended to mean a line in the center between the longitudinal edges of the weblike material but only an intermediate line that divides the weblike material into the two (or more) regions intended for the two (or more) levels.

In the new job J2 the weblike material N is divided by slit lines T1' T2', T3', T4' and T5' into two lateral trimmings R1' and R2' and also into four strips S1', S2', S3', S4', of which the first three are directed to the upper level along path PA and the fourth is directed to the lower level along path PB. Consequently the central slit line T3' has to be joined to the central line T2 of the first job by means of a transverse cut C.

Whereas in the example illustrated the number of strips S of the old job is equal to the number of strips S' of the new job, it should be realized that the number of strips in the old and new jobs may differ.

The transverse cut C has a length and position that depend on the position of the lines T2, T3' which in the old job and in the new job separate the strips that are to follow path PA from those that are to follow path PB. In order to ensure that the cut line C does not completely cut off in the transverse direction one or more of the strips of the old or new jobs, all the slit lines T and T' of both jobs J1 and J2 except the two central lines T2 and T3' are interrupted in such a way as to leave a region for the job changeover E in which only the two central slit lines, which are joined by the transverse cut C, are continued. This is done by withdrawing the tools 25 that generated the slit lines T1 and T3 earlier than the tool that generated line T2 and inserting the tool that generates slit line T3' before the tools that generate slit lines T1', T2', as described in greater detail in European patent application No. 98 830 449.9 (publication EP-A-No. 0 894 583) and in the corresponding U.S. application Ser. No. 09/124,017.

In addition to the central cut C, two lateral cuts C1, C2 are produced in the region E of the job changeover in order to interrupt the trimmings R1, R1' and R2, R2'. The slit lines T4, T5, T4' and T5' are prolonged in the region E of the job changeover in a similar way to the central slit lines T2 and T3'. Discontinuous trimmings are thus produced.

If it is wished to produce continuous trimmings, with the advantages known to those skilled in the art, it is possible to use a tool that produces cuts C1' and C2' that are inclined to the direction of forward travel F of the weblike material N, for example using the system disclosed in EPA-0 737 553, the content of which is incorporated in the present description. In this case the region of the job changeover will appear as in FIG. 3, where identical numbers denote parts identical or corresponding to those of FIG. 2. In this example the second job J2 has a different number of strips S from the first job J1. The central lines joined by the cut C are in this case lines T1 and T2'.

A cutter 100 is used to make cut C: it may be positioned upstream or downstream of the slitting and scoring stations 1, 3, 5, 7, as shown in FIG. 1, where the alternative position upstream of the slitting and scoring is indicated in chain line.

The cutter 100 comprises a rotating cutting cylinder 101 with cutting means indicated generally by the number 103, which acts in combination with a rotating opposing cylinder 105. The latter is advantageously covered with a soft material, e.g. semirigid polyurethane.

The structure of the cutting cylinder 101 is a specific subject of the present invention and will be described in detail below with reference to FIGS. 4–7.

Figure 4:
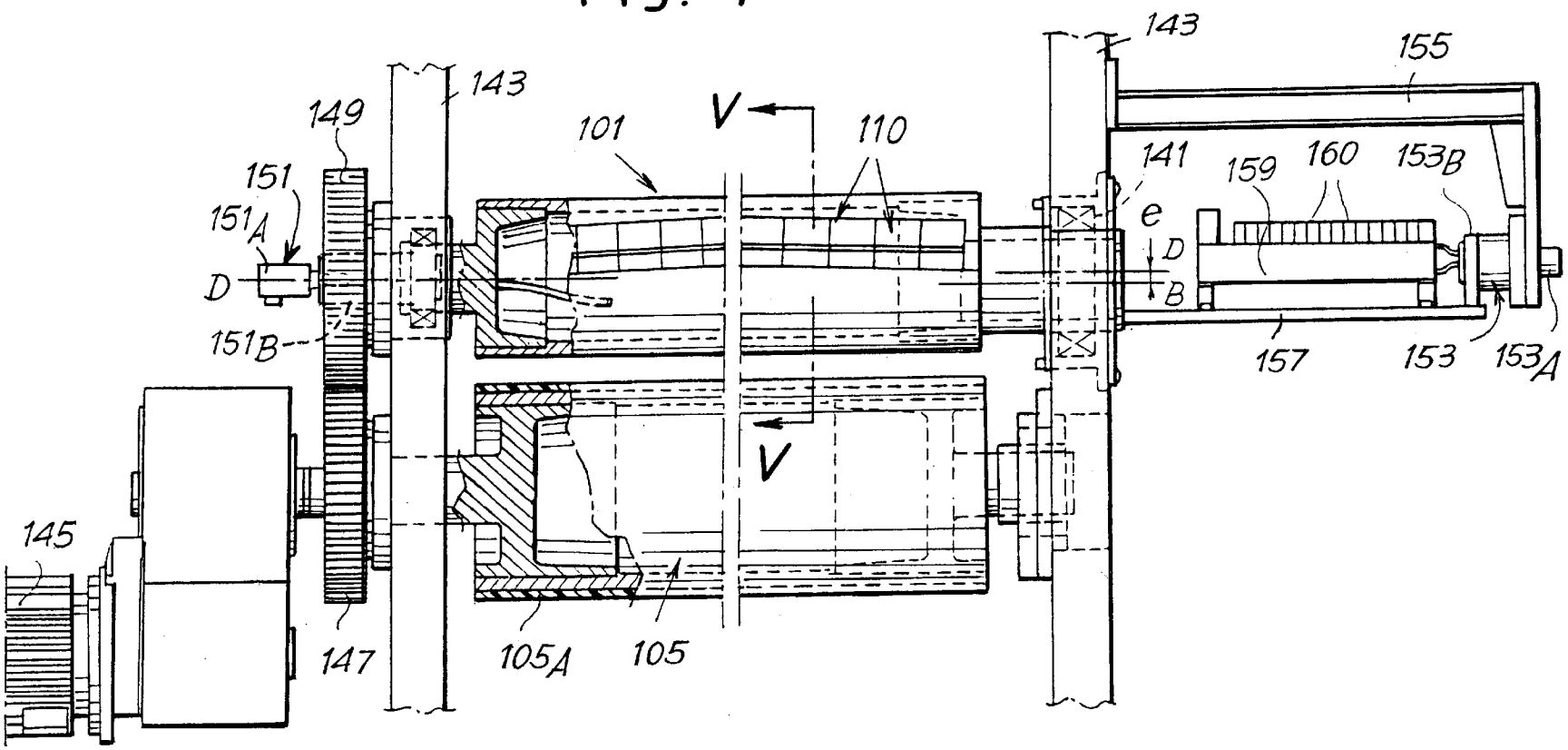
FIG. 4 shows schematically a front view marked IV—IV in FIG. 1 of the cutting cylinder and opposing cylinder.

Arranged along the length of the cutting cylinder 101 are blade segments mounted on suitable pivoting parts so as to be selectively extended and moved into the cutting position by respective actuators positioned inside the cutting cylinder 101. FIG. 4 schematically indicates the positions of the pivoting parts for the blade segments, which here have the general reference 110. As can be seen in FIG. 4, the pivoting parts are laid out along two helical lines of opposite inclination forming a sort of upsidedown V on the cutting cylinder 101.

The pivoting parts with their respective blade segments and associated actuators may be identical to each other and differ only in the different angle at which they are set on the cutting cylinder 101. One of these mechanisms will be described below in detail with reference to FIGS. 5–7.

Figure 5:
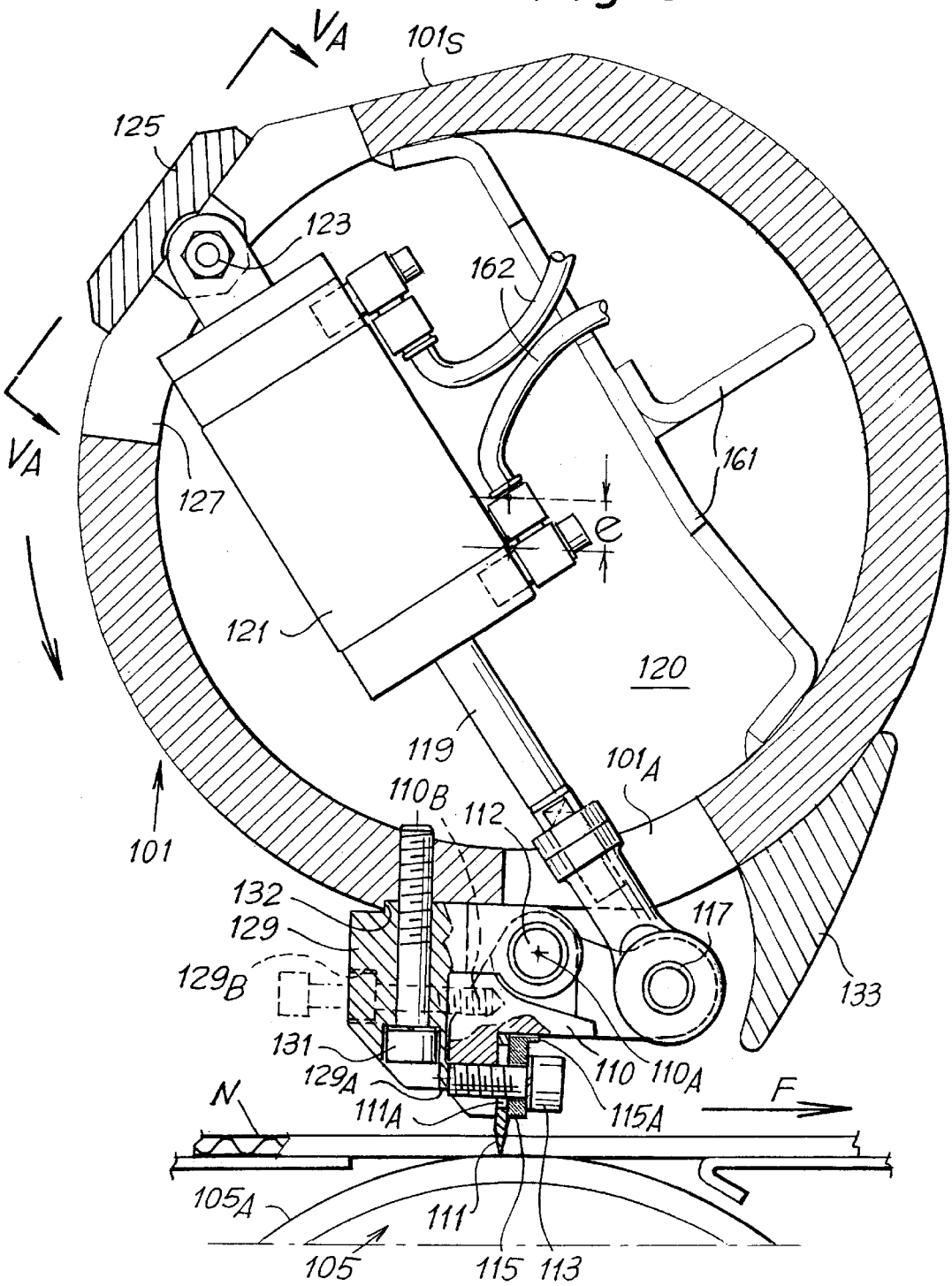
FIG. 5 shows an enlarged cross section marked V—V in FIG. 4 through the cutting cylinder.

In FIG. 5 the blade segment (usually serrated) is numbered 111. It is fastened, by clamping screws 113 and a block 115, to its pivoting part 110 hinged about a pin 112 with a hinge axis 110A. The block 115 has a tooth 115A which, in the position shown in FIG. 5, is turned so as to face away from the blade segment 111. When the soft material of the opposing cylinder 110 has become so worn as no longer to guarantee sufficient interference between the covering of the opposing cylinder and the blade, as must occur in order to cut through the full thickness of the weblike material, each blade segment can be moved into a more projecting position by turning the block 115 around so that the tooth 115A is inserted underneath the blade segment 111, forming a distance piece. So that the blade segment can be locked in this position the segment has slotted holes 111A for the insertion of the clamping screws 113.

The pivoting part 110 is hinged on a ball joint 117 to the rod 119 of a piston/cylinder actuator, of which 121 is the cylinder. For each blade segment 111 the wall of the cutting cylinder 101 has a first slot 101A for the passage of the rod 119 of the piston/cylinder actuator 119, 121.

The piston/cylinder actuator 119, 121 is housed in the cavity 120 of the cylinder 101 and is hinged at 123 to a plate 125 mounted on the cutting cylinder 101 and extending across a second slot 127 of sufficient dimensions to allow the introduction of the piston/cylinder actuator 119, 121 during assembly of the apparatus. Another ball joint may be used at the hinge point 123.

The pin 112 is supported by a block 129 fastened by screws 131 to the outer surface of the cutting cylinder 101, on a seat 132 made e.g. by milling said outer surface. The block 129 forms a stop 129A on which the pivoting part 110 rests when in the extended position, i.e., with the blade segment 111 in the cutting position, as shown in FIGS. 5 and 6. In this position the blade segment 111 is between the pivot axis 110A of the part 110 and the stop 129A. The stresses exerted on the blade segment 111 during cutting are therefore absorbed by the pin 112 and by the stop 129A and via these by the cutting cylinder 101, without being absorbed by the piston/cylinder actuator 119, 121. This ensures that the blade segment 111 is held rigidly in its position during the cutting action.

During the cutting action the cutting cylinder 101 turns counterclockwise in FIG. 5 (where the direction of forward travel of the weblike, material is marked F), at an angular velocity such that the linear velocity of the blade segment 111 is slightly greater than the feed velocity of the weblike material. As a consequence of this there are no forces on the rod 119 of the piston/cylinder actuator 119, 121. Any forces exerted by the weblike material in the direction of forward travel of the material and due to feed problems are absorbed by the apparatus and do not result in damage to the blade segment 111, since they tend to compress the piston/cylinder actuator 119, 121.

In front of the pivoting part 110 is a shaped guard 133 made of plastic or equivalent material which covers among other things the cutting edge of the blade segment 111 when this is in the non-operating position of FIG. 7, which is reached by retraction of the rod 119 and consequent pivoting of the pivoting part 110 about the axis 110A.

Figure 3:
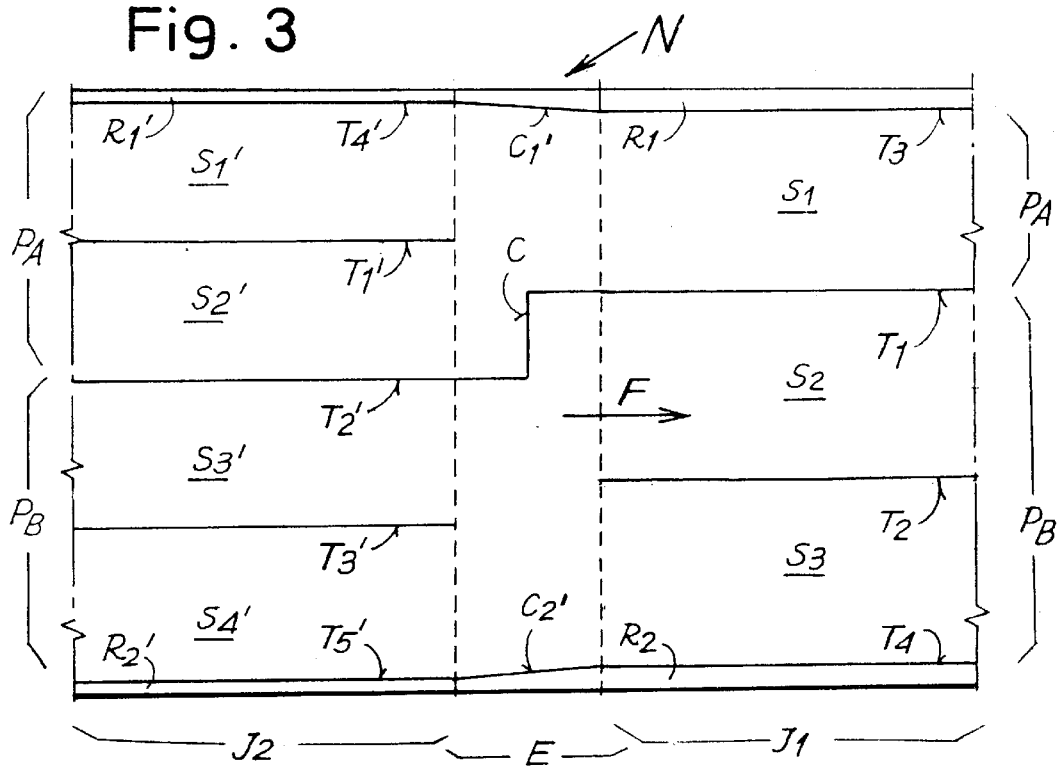
FIG. 3 shows the region of a job changeover on the weblike material in a second embodiment of the invention.

Since, as mentioned earlier, the lateral trimmings R1, R2, R1', R2' of the weblike material N have to be cut transversely at each job changeover (unless using the slitting systems which generate a continuous trimming as shown in FIG. 3), the two outermost blade segments 111 can be made immobile rather than retractable like that illustrated in FIG. 5.

The helical arrangement of the blade segments 111 and of their respective pivoting support parts 110 necessitates an inclined arrangement of the pivot axes 110A also. To avoid interferences between adjacent blade segments 111 during the pivoting movement, due to the differing inclinations of the contiguous pivot axes, the blade segments themselves may be slightly rounded at their ends.

In every pivoting part 110 there is advantageously a tapped hole 110B which, with the part 110 extended (FIGS. 5 and 6) lines up with a through hole 129B passing through the block 129. This means that a screw can be used to lock the pivoting part 110 in the extended position, for instance when the actuator 119, 121 control and actuating apparatus has failed, thus allowing the plant to continue to operate even if in a non-optimal way. It is even possible, with this system, to lock all blade segments in the extended position and consequently use the cutting apparatus as an ordinary cutter for the transverse cut.

The geometrical axis of the cutting cylinder 101 is marked B—B in FIG. 4 and in FIG. 5. However, it is supported eccentrically in bearings 141 housed in side plates 143 (FIG. 4). The axis of the bearings 141 is marked D—D in FIGS. 4 and 5. The eccentricity "e" between axes B—B and D—D is determined in such a way as to balance the cutting cylinder 101 about the axis of rotation D—D, without the need to add counterweights to counterbalance the blade segments 111 with their associated pivot mechanisms. In order to keep the cutting cylinder 101 from touching the weblike material N when it executes a revolution of 360° to make the cut C, the cylinder may optionally comprise (as indicated in the example illustrated) a flat 101S in an approximately diametrically opposite position to each blade segment 111. Because the blade segments 111 are arranged along two helical portions (cp. FIG. 4), the flats 101S are also preferably formed in this arrangement.

The rotary motion to the cutting cylinder 101 is supplied, in the example illustrated, by a motor/gearbox assembly 145 and by a gear wheel 147 on the output of the motor/gearbox assembly 145 and keyed to the shaft of the opposing cylinder 105, where it meshes with a gear wheel 149 keyed to the shaft of the cutting cylinder 101. The motor/gearbox assembly 145 delivers to the cutting cylinder 101 and to the opposing cylinder 105 a velocity greater than the feed velocity of the weblike material. Furthermore, the two gear wheels 147, 149 have a different number of teeth from each other so that the blade segments 111 act in combination with constantly varying areas of the opposing cylinder 105, hence distributing the wear around the soft material covering 105A of the latter. It is obvious that the motion to the cutting cylinder 101 and opposing cylinder 105 can be delivered by other mechanisms, for example by a motor with a belt drive system. In the latter case there would also be more uniform wear of the covering material of the opposing cylinder 105.

Fitted to a first end of the cutting cylinder 101 is a first rotary distributor 151 (cp. FIG. 4) through which compressed air is supplied to operate the actuators 119, 121. The number 151A indicates the fixed part and 151B the rotary part of the distributor. At the other end of the cutting cylinder 101 is a second rotary distributor 153, with a fixed portion 153A carried by a fixed bracket 155 integral with the side plate 143, and a rotary portion 153B carried by a rotary bracket 157 integral with the cutting cylinder 101. The distributor 153 supplies the control signals to the solenoid valves of the individual actuators 119, 121 and the electrical power to operate them. The rotary bracket also carries a serial transmission module 159 for the solenoid valve manifold. In practice, the module 159 contains all the solenoid valves (shown schematically at 160) of the piston/cylinder actuators 119, 121, of which there is the same number as there are actuators. The solenoid valves are then connected to the individual piston/cylinder actuators 119, 121 by twice as many tubes as there are actuators.

The pneumatic input to the module 159 is connected to the distributor 151 by a pipe running axially all the way through the cutting cylinder 101, while the 2×n outputs (n being the number of piston/cylinder actuators housed inside the cutting cylinder 101) are connected to the same number of tubes that lead to the individual actuators (marked 162 for the actuator of FIG. 5). The space inside the cutting cylinder 101 contains fastening systems 161 so that the above-described pneumatic pipes can be secured appropriately.

This arrangement makes it possible to position all the solenoid valves on one side of the cutting cylinder and outside of its cavity, in an easily accessible position for maintenance.

The module 159 may be, e.g. a serial transmission unit series EX 120/121-SM J1 produced by SMC Corporation, Shimbashi, Minato-Ku, Tokyo, Japan, or by SMC Pneumatics Inc, Indianapolis, USA.

As an alternative, the module 159 may be replaced with a module that distributes the power and control signals to the solenoid valves, which are positioned directly on the actuators, in which case it will be necessary for each piston/cylinder actuator 119, 121 to have a pipe connecting it to the first distributor 151 for its compressed air supply.

Different arrangements for distributing control signals and power can be adapted when the blade segments are operated by other types of actuators. For example, if electromechanical or electromagnetic actuation is employed, a distributor of signals and electrical power will be sufficient on one end of the cutting cylinder. From a module arranged in this position, preferably in an external position like the module 159, individual leads can be run to supply control signals and power to the actuators associated with each blade segment or group of blade segments.

The apparatus described above works as follows: when the processing of a first job J1 is near its end and processing of a second job J2 must be commenced, the installation's central control unit knows the position (with respect to the width of the weblike material N) of the central slit line of the first job and the position of the central slit line of the second job. It therefore determines which and how many of the blade segments 111 must be extended to produce the central cut C.

The module 159 causes the selected blade segments to be extended and at the moment of the job changeover the cutting cylinder 101 executes a turn of almost one complete revolution causing the blade segments to cut the weblike material N at the desired portion. The cutting cylinder 101 then remains stationary until the next job changeover. As mentioned, a continuously rotating cutting cylinder, with the blade segments retracted until the time of the job changeover, is not ruled out. Another possibility is an early rotation ahead of the moment of the job changeover, e.g., to ensure that at the moment at which the blade segments must act the cutting cylinder is already rotating at the correct angular velocity. The blade segments will of course be extended only in the arc of the last rotation prior to the cut.

The blade segments 111 are arranged in a helical form in order to reduce stresses during cutting, as with this arrangement the contact between blade and weblike material occurs in a gradual manner. However, the inclination of the cut C which is produced is very slight and the cut may be considered to be approximately perpendicular to the direction of forward travel F of the weblike material N. The helical layout of the blade segments also serves to reduce stresses when all segments 111 are extended to perform a complete transverse cut through the weblike material N, which may be required in certain working conditions.

It will be understood that the drawing shows only an example purely by way of a practical demonstration of the invention, which latter may be varied in its shapes and arrangements without thereby departing from the scope of the concept on which the invention is based. The presence of any reference numbers in the appended claims does not limit their scope of protection: rather, it has the sole purpose of facilitating the reading thereof with reference to the drawings and to the foregoing description.

What is claimed is:

1. An apparatus for cutting a web material fed continuously along a path through said apparatus, said apparatus comprising:

a rotating cutting cylinder having a length and including a plurality of blade segments distributed along the length of the cutting cylinder and a plurality of actuators connected to the plurality of blade segments and operable to produce selective extension and retraction of the blade segments with respect to the cutting cylinder, at least one of the plurality of blade segments remaining retracted during a full rotation of the cutting cylinder; and an opposing member, the cutting cylinder and the opposing member being arranged on opposite sides of the path.

2. An apparatus as claimed in claim 1, wherein the plurality of actuators are housed in an axial cavity inside the cutting cylinder.

3. An apparatus as claimed in claim 1, wherein each of the plurality of actuators is connected to one of the plurality of blade segments.

4. An apparatus as claimed in claim 3, wherein each of the plurality of actuators is secured at one end to a first fulcrum integral with the cutting cylinder and at the other end to a second fulcrum integral with the corresponding blade segment.

5. An apparatus as claimed in claim 4, wherein the first fulcrum and the second fulcrum are ball joints.

6. An apparatus as claimed in claim 3, wherein the cutting cylinder has a first rotary distributor to supply the cutting cylinder with an actuating fluid for the actuators and a second rotary distributor to supply the cutting cylinder with control signals and supply power for respective solenoid valves of the actuators.

7. An apparatus as claimed in claim 6, wherein the solenoid valves of the actuators are contained in a module located at one end of the cutting cylinder.

8. An apparatus as claimed in claim 1, wherein each blade segment is supported by a pivoting part hinged about a hinge axis, extension and retraction of the blade segments being produced by a pivoting movement of the pivoting part about the hinge axis.

9. An apparatus as claimed in claim 8, further comprising a stop engageable with each pivoting part to absorb at least a portion of a stress exerted on the corresponding blade segment during cutting of the material, each pivoting part being disengaged from the stop in a non-cutting position of the corresponding blade segment.

10. An apparatus as claimed in claim 9, wherein the cutting cylinder defines a circumference, wherein each blade segment is situated, when extended, circumferentially between the hinge axis of the corresponding pivoting part and the corresponding stop.

11. An apparatus for cutting a web material fed continuously along a path through said apparatus, said apparatus comprising:

a rotating cutting cylinder having a length and including a plurality of blade segments distributed along the length of the cutting cylinder and a plurality of actuators connected to the plurality of blade segments and operable to produce selective extension and retraction of the blade segments with respect to the cutting cylinder, at least one of the plurality of blade segments remaining retracted during a rotation of the cutting cylinder; and an opposing member, the cutting cylinder and the opposing member being arranged on opposite sides of the path, wherein each blade segment is supported by a pivoting part hinged about a hinge axis, extension and retraction of the blade segments being produced by a pivoting movement of the pivoting part about the hinge axis, and wherein the cutting cylinder defines a circumference, and wherein the hinge axis is radially external to the circumference of the cutting cylinder.

12. An apparatus for cutting a web material fed continuously along a path through said apparatus, said apparatus comprising:

a rotating cutting cylinder having a length and including a plurality of blade segments distributed along the length of the cutting cylinder, each of the plurality of blade segments being selectively extended and retracted such that, during a full rotation of the cutting cylinder, one of the plurality of blade segments is extended to cut the material and another of the plurality of blade segments remains retracted so as to not cut the material; and an opposing member, the cutting cylinder and the opposing member being arranged on opposite sides of the path.

13. An apparatus as claimed in claim 12, wherein the cutting cylinder further includes a plurality of actuators connected to the plurality of blade segments and operable to selectively extend and retract the plurality of blade segments to cut the material.

14. An apparatus as claimed in claim 13 wherein the plurality of actuators are housed in an axial cavity inside the cutting cylinder.

15. An apparatus as claimed in claim 13, wherein each of the plurality of actuators is connected to one of the plurality of blade segments.

16. An apparatus as claimed in claim 15, wherein each of the plurality of actuators is secured at one end to a first fulcrum integral with the cutting cylinder and at the other end to a second fulcrum integral with the corresponding blade segment.

17. An apparatus as claimed in claim 16, wherein the first fulcrum and the second fulcrum are ball joints.

18. An apparatus as claimed in claim 13, wherein the cutting cylinder has a first rotary distributor to supply the cutting cylinder with an actuating fluid for the actuators and a second rotary distributor to supply the cutting cylinder with control signals and supply power for respective solenoid valves of the actuators.

19. An apparatus as claimed in claim 18, wherein the solenoid valves of the actuators are contained in a module located at one end of the cutting cylinder.

20. An apparatus as claimed in claim 12, wherein each blade segment is supported by a pivoting part hinged about a hinge axis, extension and retraction of the blade segments being produced by a pivoting movement of the pivoting part about the hinge axis.

21. An apparatus as claimed in claim 20, further comprising a stop engageable with each pivoting part to absorb at least a portion of a stress exerted on the corresponding blade segment during cutting of the material, each pivoting part being disengaged from the stop in a non-cutting position of the corresponding blade segment.

22. An apparatus as claimed in claim 21, wherein the cutting cylinder defines a circumference, wherein each blade segment is situated, when extended, circumferentially between the hinge axis of the corresponding pivoting part and the corresponding stop.

23. An apparatus for cutting a web material fed continuously along a path through said apparatus, said apparatus comprising:

a rotating cutting cylinder having a length and including a plurality of blade segments distributed along the length of the cutting cylinder, each of the plurality of blade segments being selectively extended and retracted such that, during a rotation of the cutting cylinder, one of the plurality of blade segments is extended to cut the material and another of the plurality of blade segments remains retracted so as to not cut the material; and an opposing member, the cutting cylinder and the opposing member being arranged on opposite sides of the path, wherein each blade segment is supported by a pivoting part hinged about a hinge axis, extension and retraction of the blade segments being produced by a pivoting movement of the pivoting part about the hinge axis, and wherein the cutting cylinder defines a circumference, wherein the hinge axis is radially external to the circumference of the cutting cylinder.

24. An apparatus for cutting a web material fed continuously along a path through said apparatus, said apparatus comprising:

a rotating cutting cylinder having a length and including a plurality of blade segments distributed along the length of the cutting cylinder, each of the plurality of blade segments being selectively extended and retracted such that, during a full rotation of the cutting cylinder, one of the plurality of blade segments is extended to cut the material and another of the plurality of blade segments remains retracted so as to not cut the material.

25. An apparatus as claimed in claim 24, wherein the cutting cylinder further includes a plurality of actuators connected to the plurality of blade segments and operable to selectively extend and retract the plurality of blade segments to cut the material.

26. An apparatus as claimed in claim 25, wherein the plurality of actuators are housed in an axial cavity inside the cutting cylinder.

27. An apparatus as claimed in claim 25, wherein each of the plurality of actuators is connected to one of the plurality of blade segments.

28. An apparatus as claimed in claim 27, wherein each of the plurality of actuators is secured at one end to a first fulcrum integral with the cutting cylinder and at the other end to a second fulcrum integral with the corresponding blade segment.

29. An apparatus as claimed in claim 28, wherein the first fulcrum and the second fulcrum are ball joints.

30. An apparatus as claimed in claim 27, wherein the cutting cylinder has a first rotary distributor to supply the cutting cylinder with an actuating fluid for the actuators and a second rotary distributor to supply the cutting cylinder with control signals and supply power for respective solenoid valves of the actuators.

31. An apparatus as claimed in claim 30, wherein the solenoid valves of the actuators are contained in a module located at one end of the cutting cylinder.

32. An apparatus as claimed in claim 24, wherein each blade segment is supported by a pivoting part hinged about a hinge axis, extension and retraction of the blade segments being produced by a pivoting movement of the pivoting part about the hinge axis.

33. An apparatus as claimed in claim 32, further comprising a stop engageable with each pivoting part to absorb at least a portion of a stress exerted on the corresponding blade segment during cutting of the material, each pivoting part being disengaged from the stop in a non-cutting position of the corresponding blade segment.

34. An apparatus as claimed in claim 33, wherein the cutting cylinder defines a circumference, wherein each blade segment is situated, when extended, circumferentially between the hinge axis of the corresponding pivoting part and the corresponding stop.

35. An apparatus as claimed in claim 24, further comprising an opposing member, the cutting cylinder and the opposing member being arranged on opposite sides of the path.

36. An apparatus as claimed in claim 35, wherein, when at least one of the plurality of blade segments is extended to engage one side of the material, the opposing member engages the other side of the material to oppose and cooperate with the at least one of the plurality of blade segments to cut the material.

37. An apparatus for cutting a web material fed continuously along a path through said apparatus, said apparatus comprising:

a rotating cutting cylinder having a length and including a plurality of blade segments distributed along the length of the cutting cylinder, each of the plurality of blade segments being selectively extended and retracted such that, during a rotation of the cutting cylinder, one of the plurality of blade segments is extended to cut the material and another of the plurality of blade segments remains retracted so as to not cut the material, wherein each blade segment is supported by a pivoting part hinged about a hinge axis, extension and retraction of the blade segments being produced by a pivoting movement of the pivoting part about the hinge axis, and wherein the cutting cylinder defines a circumference, wherein the hinge axis is radially external to the circumference of the cutting cylinder.

38. An apparatus for cutting a web material fed continuously along a path through said apparatus, said apparatus comprising:

a rotating cutting cylinder having a length and including a plurality of blade segments distributed along the length of the cutting cylinder;

a plurality of actuators connected to the plurality of blade segments, the actuators being operable to selectively extend and retract the blade segments with respect to the cutting cylinder, at least one of the plurality of blade segments being retracted and not cutting the web material; and an opposing member, the cutting cylinder and the opposing member being arranged on opposite sides of the path.

39. An apparatus as claimed in claim 38, wherein, while the at least one blade segment is retracted, at least another one of the blade segments is extended to cut the web material.

40. An apparatus as claimed in claim 38, wherein a cutting region is defined between a new job and an old job.

41. An apparatus as claimed in claim 40, wherein the at least one of the plurality of blade segments is retracted in the cutting region and does not cut the web material.

42. An apparatus as claimed in claim 40, wherein at least another one of the plurality of blade segments is extended in the cutting region and cuts the web material.

43. An apparatus as claimed in claim 38, wherein the at least one of the plurality of blade segments remains retracted during a full rotation of the cutting cylinder.

44. An apparatus as claimed in claim 38, wherein the at least one of the plurality of blade segments is retracted and does not cut the web material during a first cut of the web material, and wherein the at least one of the plurality of blade segments is extended to cut the web material during a second cut of the web material.

45. An apparatus as claimed in claim 44, wherein, during the second cut of the web material, at least another one of the blade segments is retracted and does not cut the web material.

* * * * *